US006558225B1

(12) United States Patent
Rehkemper et al.

(10) Patent No.: US 6,558,225 B1
(45) Date of Patent: May 6, 2003

(54) ELECTRONIC FIGURINES

(75) Inventors: Steven Rehkemper, Chicago, IL (US); Richard X. Zawitz, San Francisco, CA (US); Daniel Bryce, Chicago, IL (US); Dennis J. O'Patka, Chicago, IL (US)

(73) Assignee: Rehco, LLC, Chicago, IL (US)

( * ) Notice: Subject to any disclaimer, the term of this patent is extended or adjusted under 35 U.S.C. 154(b) by 0 days.

(21) Appl. No.: 10/054,489

(22) Filed: Jan. 24, 2002

(51) Int. Cl.[7] ..... A63H 29/22

(52) U.S. Cl. ..... 446/484; 446/268; 446/297; 446/321; 40/448; 463/37

(58) Field of Search ..... 446/268, 297, 446/298, 299, 300, 301–303, 321, 337, 338, 339, 484; 40/455, 448; 463/37; 345/156; 341/21

(56) References Cited

U.S. PATENT DOCUMENTS 4,456,384 A * 6/1984 Murakami ..... 368/10
5,072,998 A * 12/1991 Oh ..... 312/204
5,564,209 A * 10/1996 Zagnoli ..... 40/594
6,056,618 A * 5/2000 Larian ..... 446/73
6,160,540 A * 12/2000 Fishkin et al. ..... 345/184

* cited by examiner

*Primary Examiner*—Jacob K. Ackun
*Assistant Examiner*—Jamila Williams

(57) ABSTRACT

An electronic figurine has at least one appendage, a means for displaying electronic images in relation to a virtual character, and a circuit board. The circuit board is programmed to generate images of the virtual character including facial expressions, symbols, virtual activates, games and animated sequences. The electronic figurine further includes means for activating pre-programmed responses when a user interacts with the appendages or orientation of the figurine. Moreover, the electronic figurine may also include various audible sounds and responses that may also be activated and interacted with by a user interacting with the physical figurine.

20 Claims, 3 Drawing Sheets

ELECTRONIC FIGURINES

FIELD OF THE INVENTION

This invention relates to a three-dimensional figurine that includes various appendages and includes a means for displaying a virtual character that a user may interact with by interacting with the appendages of the three-dimensional figurine.

BACKGROUND OF THE INVENTION

Electronic figurines are widely known and include various means for a user to interact therewith. Through a variety of switches and/or buttons the user may be able to activate pre-programmed responses that cause the electronic figurines to move, dance, sing, cry, vibrate or even roller skate. More advanced electronic figurines may even have the means to detect sound or movement allowing multiple figurines to interact with each other, as well as the user. For instance, electronic figurines that can detect sound may allow the figurine to respond to various voice commands. Other electronic figurines include a variety of internal and external switches placed throughout the figurines, which when activated causes the figurines to produce various pre-programmed movement and/or sound. Commonly placed switches would include being placed in the ears, hands, feet and torso. Even more advanced figurines, such as electronic animals, include infrared switches, such that by moving in front of the electronic animal the animal would bark or meow.

While the combination of the above discussed electronic toys seem endless, these electronic toys lack the more advanced inclusion of virtual toys. Virtual toys are also widely known. Small hand-held toys, such as virtual pets, allow a user to control or interact with a virtual character, by depressing a set of buttons, typically located underneath a display screen. Pre-programmed responses related to the virtual character are released when the user depresses the buttons. For instance, the set of buttons include a feeding button, a playing button and an exercise button. Depressing the right combination of buttons can cause the virtual character to be happy and grow, while depressing the wrong combination may cause the virtual character to be angry, sad or die. In addition, display screens have also been used to produce various facial expressions such as movement associated with eyes, the mouth, ears and nose. Such virtual facial expressions and virtual characters are more commonly adapted for use on personal computers with screen savers and help stations.

However, the combination of the electronic figurine with a virtual character is lacking. While prior art does exist that attempts to combine the two, for instance U.S. Pat. No. 6,056,618 to Larian describes a toy character with an electronic game unit, the prior art lacks the ability to interact with the virtual character, through the interaction with the physical character. The Larian patent combines a physical stuffed toy, like a teddy bear, and attaches a removable virtual game unit. The removable virtual game unit includes an LCD screen and a series of buttons located underneath the screen, which provides the user with the ability to interact with a virtual character having pre-programmed characteristics. The only connection between the physical stuffed toy and the virtual character is that the two may be similar, such that a toy teddy bear may include a virtual bear character, or a stuffed toy rabbit may include a virtual rabbit character. Further related art may also include figurines with an LCD screen provided in the chest. These electronic toys, similar to the Larian patent, simply provide a physical figurine and a separate electronic toy or game. The only connection between the two toys is that the game is related in some fashion to the physical character. However as mentioned above, the Larian patent and other related art lack the ability to interact with the virtual character, through the interaction with the physical character.

SUMMARY OF THE INVENTION

In accordance with the present invention, there is provided an electronic figurine that includes a physical three-dimensional figurine with appendages and includes a virtual character that the user may interact with by interacting with the appendages. More specifically, there is provided a physical figurine that includes a display screen, which is also shaped as a computer monitor, as the head and the body. Sprouting from the monitor are various physical appendages of the figurine such as legs, feet, ears, tails, hair and/or arms. The face of the physical figurine is entirely controlled by pre-programmed virtual facial expressions. However, the display screen further displays other pre-programmed images that include symbols, words, and animation sequences that include a virtual figurine (shaped similarly to the physical figurine) living in a virtual environment doing various virtual activities. The pre-programmed images personify a specific personality that includes behavior and characteristics that relate to the electronic figurine. In additional embodiments, a speaker and/or a LED source are included to further facilitate the behavior and characteristics provided in audible sounds and physical changes or characteristics.

For exemplary purpose only, one individual figurine may include a rude personality. This rude personality is typically associated with specific behavior and characteristics. Virtual characteristics associated to an electronic figurine with a rude personality may include mean virtual facial expressions, such as the tongue sticking out; and rude virtual activities, such as mud throwing. Audible characteristics associated with a rude personality may include spitting sounds, and physical characteristics may include darker colors such as red and black.

In further embodiments each electronic figurine is provided with a specific virtual environment where the figurine supposedly lives. This virtual environment further defines the personality of the electronic figurine, for example, if the electronic figurine lives in the mountains, activities may include rock climbing or cliff diving.

The electronic figurines further includes a plurality of switches and/or sensors that are triggered by interacting with the appendages of the physical figurine, for instance by pulling its arms or tail, rubbing its feet, brushing its hair, or shaking and turning it over, etc. The switches and/or sensors trigger the electronics to play pre-programmed responses on the display means, emit various sounds through the speaker and/or change various colors through the LED source. For example, if the electronic figurine is sleeping, the display means may show a virtual facial expression of eyes closed, or a virtual activity showing the virtual figurine sleeping in a bed, or symbols may be displayed showing "ZZZ's" scroll across the LCD screen, audible sounds such as snoring may also be played. If the user shakes the electronic figurine or pulls the tail of the physical figurine, a sensor may be triggered which will cause the electronics to play a pre-programmed response associated with waking someone up. For example, the virtual display may change from a virtual sleeping activity to a virtual activity showing the figurine getting out of bed, and the audible sounds may also change from snoring to a yawn. As such, it will be further described in greater detail below, that the present invention provides a user with the ability to interact with a virtual figurine by interacting with the physical figurine, which in turn may also change audible and/or physical characteristics.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE DRAWINGS

Figure 1:
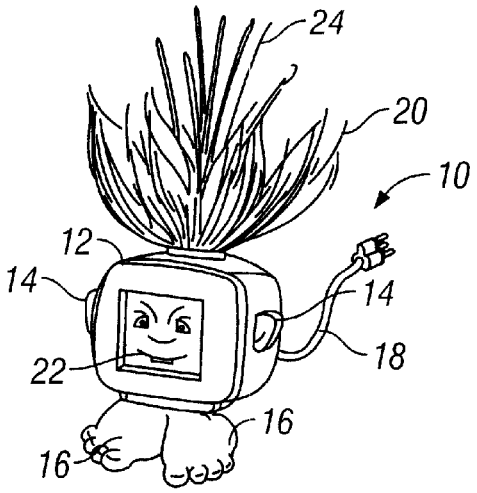
FIG. 1 is a perspective view of an electronic figurine having a generic form of a character.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Referring now to FIG. 1, an electronic figurine in accordance with one embodiment of the present invention is illustrated. In general the figurine fits in the palm of the user's hand. However, the external features of the figurine such as size, color and/or shape, may change without departing from the scope of the present invention. Moreover, it is preferably to produce various designs, colors and shapes of the figurine in order to increase appealing qualities and the collectability of the invention.

The electronic figurine includes a physical figurine 10 that is defined by a monitor 12 that is sprouting various appendages, which may include ears 14, feet 16, a tail 18 and hair 20. These appendages thus provide the monitor 12 with the personification of a real physical being. The monitor 12 houses conventional electronics (not shown), which are pre-programmed to provide a specific personality that includes behaviors that relate to such personality. The physical figurine 10 includes as a face an LCD screen 22 that is utilized to display pre-programmed images that include virtual facial expressions, symbols, words and animation sequences and include a virtual character living in a virtual environment doing virtual activities or playing games that the user may control or play be interacting with the physical figurine. The pre-programmed images personify the specific personality defined for the specific electronic figurine. In addition, a speaker 78 and a multi-color LED source 80 are included, shown in FIG. 2, to further facilitate the behavior and characteristics. Pre-programmed electronic sounds, such as simulated speech, music, and animal and mechanical sounds, may be emitted in response to the interaction with the appendages or physical figurine, as well as color changes defined by the LED source 80.

For example, an individual figurine may include a nice personality. This happy personality is typically associated with specific behavior and characteristics. Virtual displays associated to an electronic figurine with a nice personality may include happy virtual facial expressions, such as smiling; and nice virtual activities, such as bicycle riding. Audible sounds associated with a nice personality may include "Hello, how are you today," and physical appearances or color changes may include bright colors such as green and yellow.

It is also important to note that each electronic figurine is provided with a virtual environment where the figurine supposedly lives. This virtual environment further defines the personality of the electronic figurine and the virtual activates or games are interrelated to the environment. For example, a virtual character that resides in the virtual rocky environment may be shown climbing and sky diving, while a virtual character residing in a virtual water environment may be shown swimming and fishing. Each virtual character may be displayed doing a variety of pre-programmed activities or games, such as running, climbing, flying, reading, driving, etc., which as mentioned above are defined specifically for the virtual environment. Multiple pre-programmed personalities and virtual environments may be defined in different electronic figurines.

As mentioned above the behavior, emotions and characteristics of the figurine 10 are further perceived through the various pre-programmed electronic sounds. For instance, if the figurine is in a state of boredom, the figurine may emit snoring sounds, or if the figurine is happy, the figurine may emit whistling sounds.

As defined, the physical figurine 10 includes a virtual face and a virtual character doing virtual activities or games and living in a virtual environment. In accordance with the present invention, the user is further capable of interacting with the virtual character by interacting with the physical figurine or more specifically with the appendages of the physical figurine. This is facilitated through a variety of switches or sensors that when activated trigger the electronics to play pre-programmed responses that allow the user to interact with the virtual character by changing facial expressions, virtual activities, animation sequences and play games. In addition the interaction may change or alter audible sounds and/or physical changes by for instance changing colors.

Figure 2:
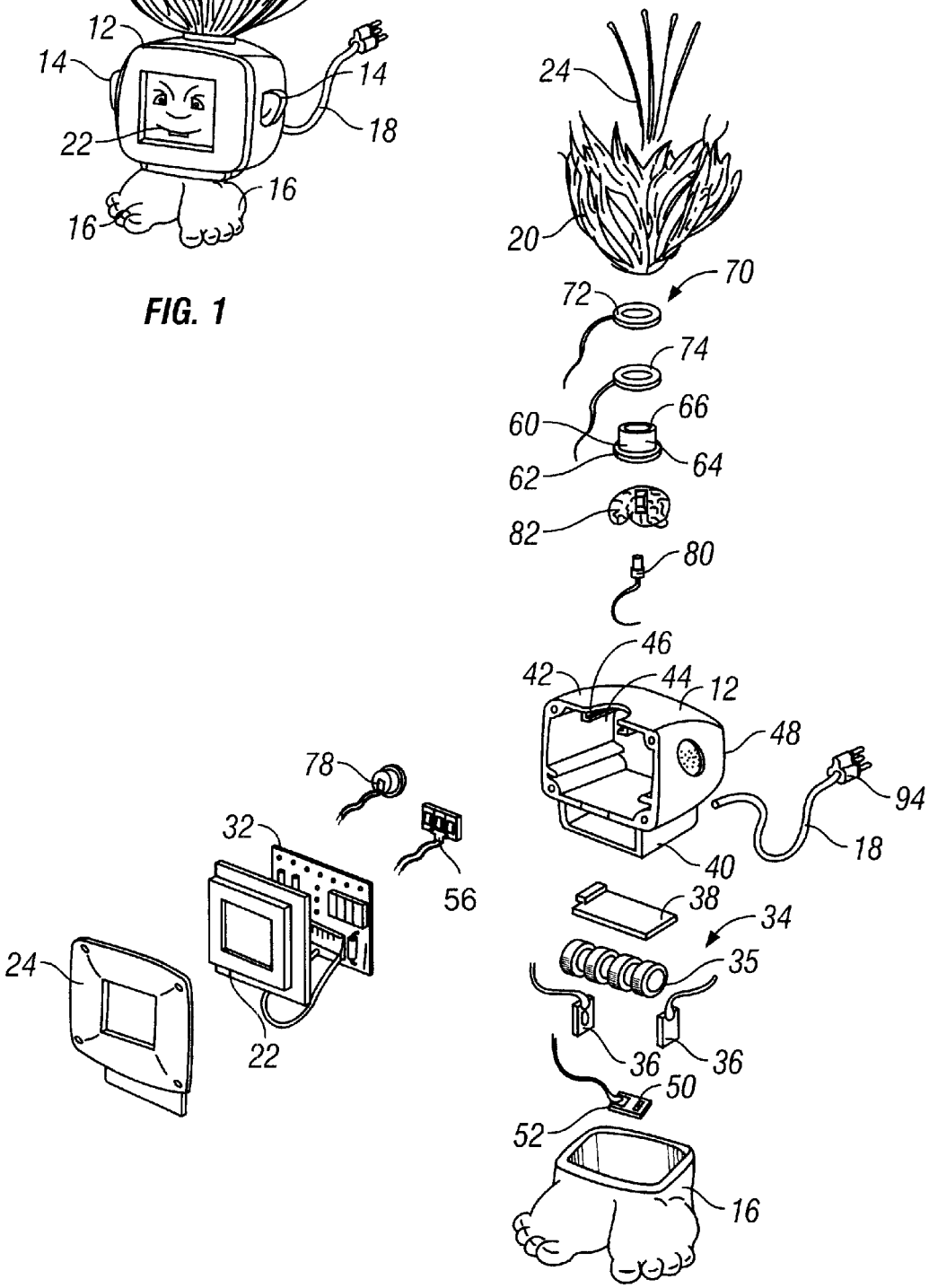
FIG. 2 is an exploded view of the figurine depicted in FIG. 1.

Referring now to FIG. 2 where the internal components of FIG. 1 are discussed in greater detail. As mentioned above, the figurine 10 includes a monitor 12 that houses the various electronics. Appendages, such as the tail 18, hair 20, and feet 16 are secured to the monitor 12, such that when assembled the monitor 12 has a personification of a living character. Internally, the monitor 12 houses the LCD screen 22 that is secured to the front end of the monitor by a cover 24. The LCD screen 22 is in communication with a circuit board 32, which is further in communication with a power source 34, or battery pack, discussed in greater detail below.

As discussed throughout, the circuit board 32 includes pre-programming instructions that when triggered by the switches will change virtual displays, emit various audible sounds and /or change various colors. As such, a second figurine may include different programming instructions, which when triggered would change these differently from another.

Multiple figurines would also include different personality, behavior, attitudes and characteristics, all of which may be programmed into the electronics. For instance, one figurine may have a musical personality, displaying images, facial expressions and emitting sounds and/or colors synonymous with a rock star. As such the figurine would display animation sequences showing the figurine playing a guitar or drums, and emitting sounds indicative of the same. In a second example, the figurine may be a computer wizard, displaying code matrices and emitting computer beeps. The examples listed herein are only exemplifications of the various embodiments and are not meant to limit the scope of the invention.

Continuing to refer to FIG. 2, the monitor 12 of the figurine 10 includes a bottom portion 40, a top portion 42 and a backside 48. The bottom portion 40 extends downwardly from the monitor 12 and is sized to frictionally connect with the feet 16 permitting the figurine 10 to have a standing orientation. The top portion 42 includes an aperture 44, discussed in greater detail below. Internally, the monitor 12 includes a shelf 46 located about the aperture 44 in the top portion 42, also discussed below. The backside 48 includes an opening (not shown), which is sized to receive the tail 18.

The feet 16 houses the power source 34, which includes a battery pack 35. battery contacts 36 and a battery door 38. The feet 16 or an access panel is removably attached to the bottom portion 40 of the monitor 12, in order to permit the user to change the batteries.

Figure 3:
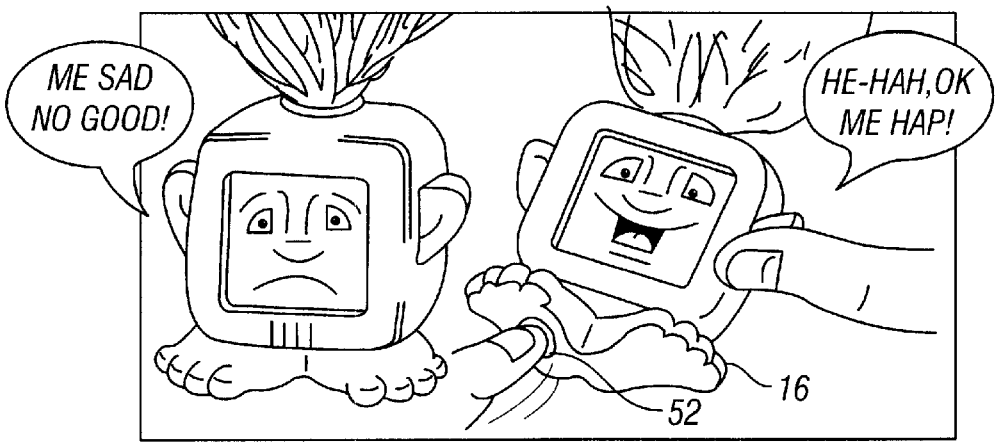
FIG. 3 is a perspective view of the figurine depicted in FIG. 2 while a user is interacting the one of the adjusting means located in the base or feet of the electronic figurine.

The feet 16 further include a triggering means or foot switch 50, which is in communication with the circuit board 32. The foot switch 50 has a switching mechanism 52, which is accessible from the bottom of the feet 16, through an aperture (not shown), illustrated in FIG. 3. When the switching mechanism 52 is depressed or rubbed by a user, the foot switch 50 sends a signal to the circuit board 32 triggering the circuit board. While the foot switch 50 may trigger various pre-programmed responses, a preferable response may include changing facial expressions and sounds, as if the figurine 10 was being tickled.

Continuing to refer to FIG. 2, another triggering means, such as a tail switch 56, may be incorporated in connection with the tail 18. When the tail 18 is pulled, the tail switch 56 sends a signal to the circuit board 32, triggering a pre-programmed response. Yet another triggering means may be employed in connection with the hair 20.

Figure 4:
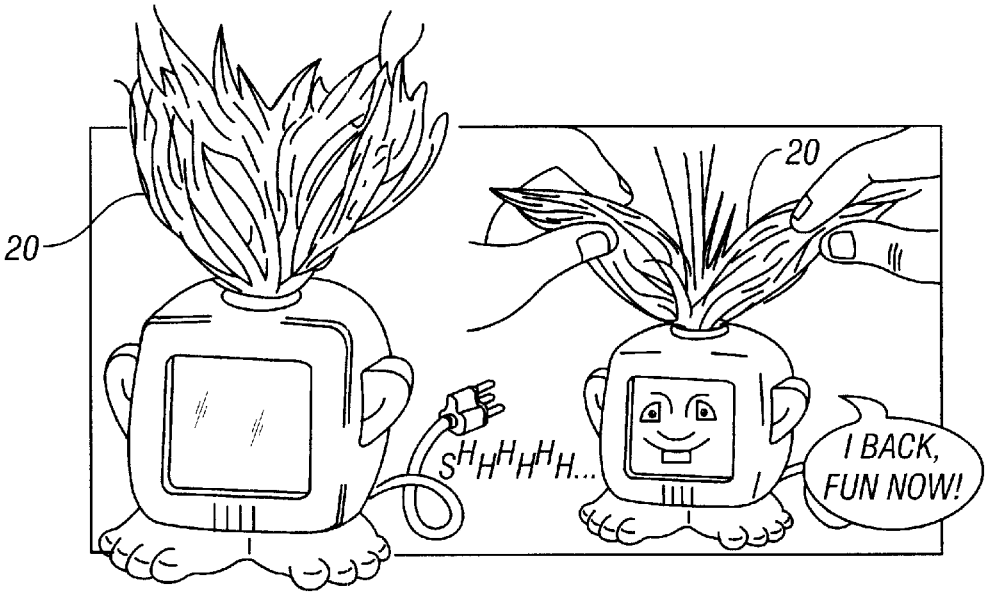
FIG. 4 is a perspective view of the figurine depicted in FIG. 2 while a user is interacting the one of the adjusting means located in the hair of the figurine.

The hair 20 is secured to the figurine 10 through a hair collar 60, which is defined by a circular base 62, an elongated portion 64 extending outwardly from the circular base 62 and a bore 66 extending there through. The circular base 62 is sized to be received in the shelf 46 of the monitor 12, while the elongated portion 64 extends through the aperture 44 in the top portion 42 of the monitor 12. The triggering means consists of a hair switch 70, which includes a top and bottom contact 72 and 74 respectively. The top and bottom contacts are in communication with the hair 20 and the circuit board 32 such that when the hair 20 is pulled, brushed or moved, the top contact 72 moves relative to the bottom contact 74, opening and closing the contacts in the hair switch 70. Signals, in response to the movement of the hair 20, are received by the circuit board 32 triggering the circuit board 32 to play pre-programmed responses. For instance, if the hair is pulled, the figurine 10 may emit sounds such as, "OUCIH" or, as illustrated in FIG. 4, if the figurine 10 was in a resting mode because of inactivity the response may be "I'm back, let's play." Other responses may include various image displays and changes in the hair color.

The aforementioned switches also permit the user to interact with the virtual character. While interacting with the physical and virtual character, the virtual character may enter into a game or activity sequence, which the user controls by activating various switches. For example, if the activity is skydiving, the user may be required to keep the virtual character from hitting birds that fly across the screen. By activating various switches, the user can move the virtual character from the left to the right or up and down. Other games are further contemplated by various programming means.

Continuing to refer to FIG. 2, the figurine 10 may further incorporate a speaker 78, which is in communication with the circuit board 32 and is utilized to emit the sounds. To facilitate changes in color, the figurine 10 may include a multi-color LED source 80 that is in communication with light pipes 24, which are seen in the hair 20. The light pipes 24 are placed through the bore 66 of the hair collar 60 and attached to a light pipe collar 82. Preferably the light pipe collar 82 is shaped as a brain, and is seen through a transparent monitor 12, thereby providing the user with the ability to see the brain change colors as well as the hair. The light pipe collar 82 further connects to the multi-color LED source 80, which is in communication with the circuit board 32.

Figure 5:
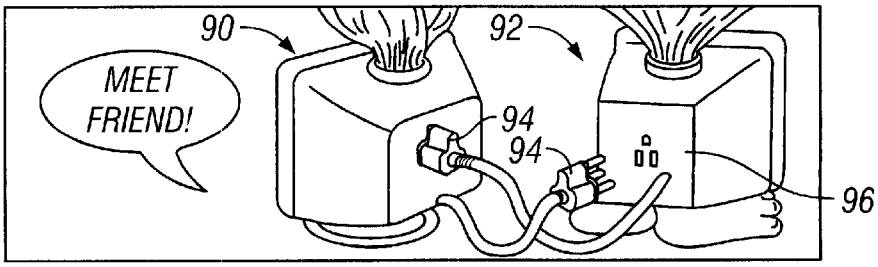
FIG. 5 is a perspective view of two figurines being plugged into each other.

In addition two figurines may be connected to each other such that the figurines may exchange and share information with each other. As illustrated in FIG. 5, two figurines, a first and a second figurine 90 and 92, are being connected to each other. As illustrated, each tail includes a tail plug 94, which may be inserted into an outlet 96 on the backside of each figurine. The outlet 96 is further in communication with the figurine's electronics. When connected, the two figurines may share or exchange information from each other. For instance, if the first figurine 90 is bored and the second figurine 92 is plugged into the first, then the two figurines may play together. Moreover, each virtual character may share with the other information in relation to the virtual environment such that the figurines could be programmed to explore each other's environment when connected together. In addition, other means for connecting the two figurines together may be employed, for instance the two figurines may exchange information by various wireless means, such as through infrared sensors. Alternatively, the figurines may employ other male/female adaptor plugs, such as in the ears, allowing multiple figurines to interconnect by lining the figurines ear to ear.

Figure 6:
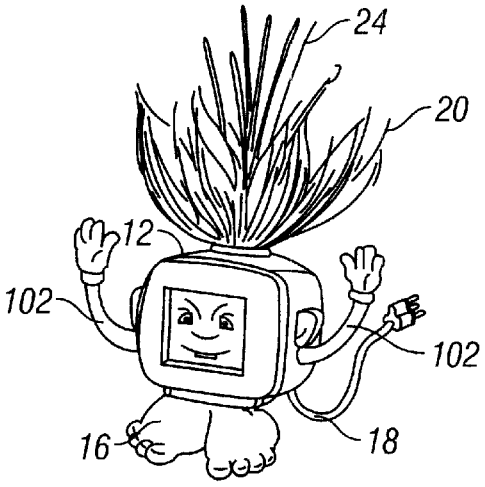
FIG. 6 is a perspective view of an other embodiment in accordance with the present invention.
Figure 7:
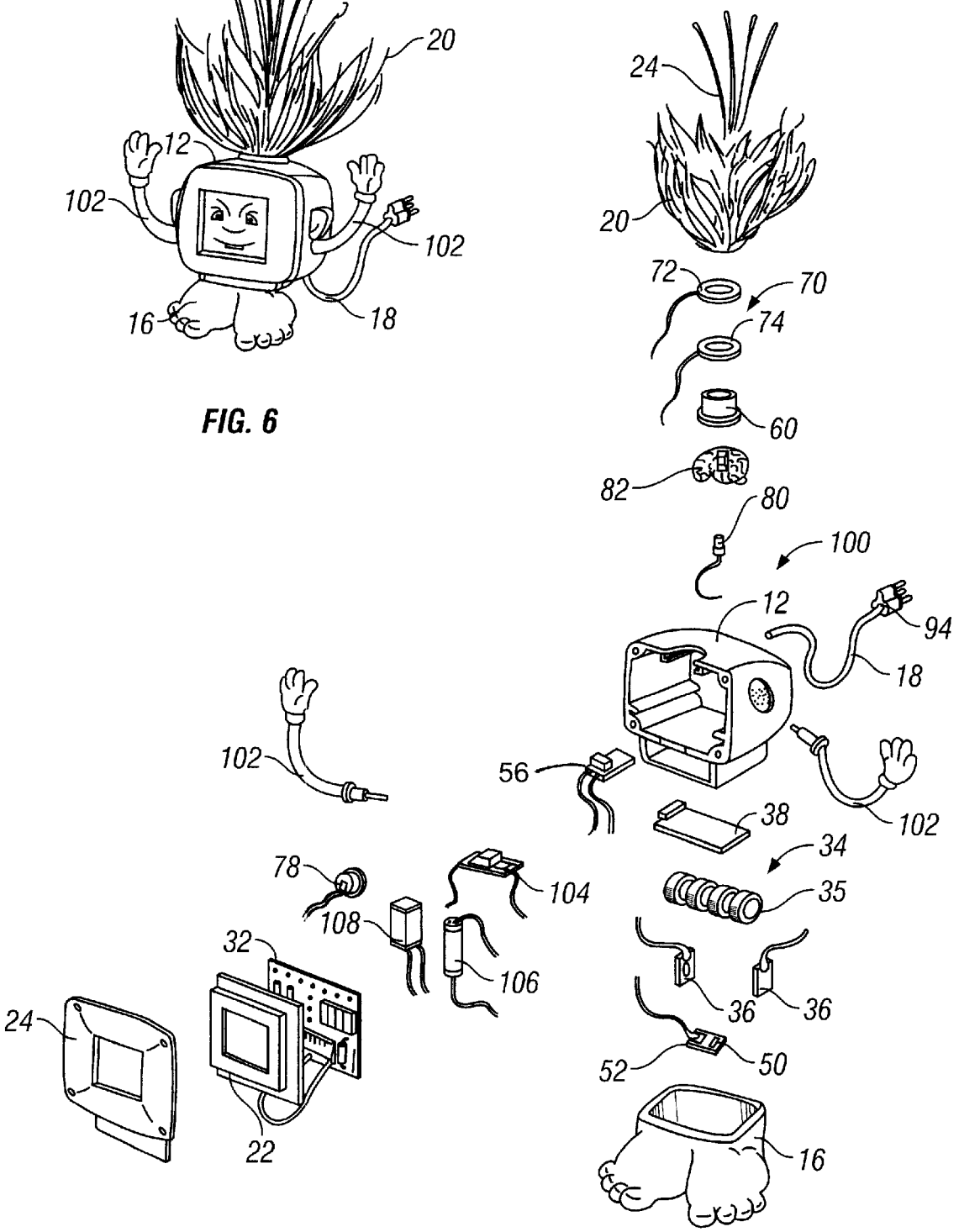
FIG. 7 is an exploded view of the figurine depicted in FIG. 6.

Referring now to FIGS. 6 and 7 a second embodiment of a figurine 100 is illustrated. As described above, the figurine 100 includes similar triggering means in the feet 16, hair 20, and tail 18, as well as similar means to display and emit sounds, such as the speaker 78, LCD screen 22 and/or multi-color LED source 80 to change the color of the light pipes 24. Moreover, a circuit board 32 is in communication with a power source 34 and the various triggering means.

The figurine 100 may also include arms 102 attached to the sides of the housing 12 and may include another triggering means in connection with the arms 102. The triggering means is defined by an arm slide switch 104 that is connected to the arms 102 such that when the arms 102 are pulled, the circuit board 32 is triggered.

The figurine 100 may also include triggering means when the figurine 100 is moved from a first orientation such as when the figurine is shaken or turned upside down. In order to facilitate such triggering means, the figurine 100 includes a gravity switch 106 that when the figurine 100 is turned upside down, the gravity switch 106 communicates the orientation of the figurine 100 to the circuit board 32. The figurine may also include a second orientation switch that sends a signal to the circuit board 32 when the figurine is shaken, such as a motion switch 108.

In addition, other switches that may be incorporated include a light switch that senses changes in light. This type of triggering means may invoke response that are associated with sleeping when the lights are turned off or awakening when the lights are turned on.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. An electronic figurine comprising:

a means for displaying electronic images;

a circuit board pre-programmed to generate images associated with a virtual figurine on said display means; and a plurality of appendages extending from the displaying means, defining a physical figurine, and at least one appendage, of the plurality of appendages, is in communication with a switch that is in further communication with the circuit board to activate a pre-programmed response associated with the virtual figurine when said appendage is interacted with by a user, whereby when a user interacts with said appendage, the circuit board plays pre-programmed responses associated with the virtual figurine, thereby permitting a user to interact with the virtual figurine by interacting with the physical figurine.

2. The electronic figurine of claim 1 wherein, the at least one appendage includes hair in communication with a hair switch that is in further communication with the circuit board, the hair switch being configured to send a signal to the circuit board when the hair is pulled or moved, such that when a user pulls or moves the hair, the hair switch sends a signal to the circuit board triggering a pre-programmed response.

3. The electronic figurine of claim 1 wherein the at least one appendage includes feet in communication with a foot switch that is in further communication with the circuit board, the foot switch being configured to send a signal to the circuit board when the foot switch is pushed or rubbed, such that when a user pushes against or rubs the foot switch, the foot switch sends a signal to the circuit board triggering a pre-programmed response.

4. The electronic figurine of claim 1 wherein at least one appendage includes a tail in communication with a tail switch that is in further communication with the circuit board, the tail switch being configured to send a signal to the circuit board when the tail is pulled, such that when a user pulls the tail, the tail switch sends a signal to the circuit board triggering a pre-programmed response.

5. The electronic figurine of claim 1 wherein at least one appendage includes a pair of arms in communication with an arm switch that is in further communication with the circuit board, the arm switch being configured to send a signal to the circuit board when one of the arms is pulled, such that when a user pulls at least one of the arms, the arm switch sends a signal to the circuit board triggering a pre-programmed response.

6. The electronic figurine of claim 2 further comprising light pipes attached to a multi-color LED source and intertwined within the hair, the LED source is further in communication with the circuit board such that a pre-programmed response includes changing the color of the multi-color LED source.

7. The electronic figurine of claim 1 further comprising:

a means for interconnecting at least two similarly configured electronic figurines such that the two electronic figurines may exchange information.

8. An electronic figurine having at least two appendages defining a physical figurine, further comprising:

a means for displaying electronic images;

a means for emitting sounds;

a circuit board in communication with the displaying means and emitting means, and when activated, the circuit board generates pre-programmed response associated to virtual images on the displaying means and sounds through the emitting means, wherein the virtual images and sounds are associated with a virtual figurine corresponding to the physical figurine, a means for activating the circuit board to generate a pre-programmed response when a user interacts with one of the appendages of said at least two appendages, whereby a user interacting with said appendage interacts with the virtual figuring by generating pre-programmed responses.

9. The electronic figurine of claim 8 wherein the virtual images includes virtual facial expressions, symbols, activities, games or animated sequences.

10. The electronic figurine of claim 9 wherein the at least one appendage includes hair and the activating means includes a hair switch that is configured to send a signal to the circuit board when the hair is pulled and moved.

11. The electronic figurine of claim 9 wherein the at least one appendage includes feet and the activating means includes a foot switch that is configured to send a signal to the circuit board when the foot switch is pushed or rubbed.

12. The electronic figurine of claim 9 wherein the at least one appendage includes a tail and the activating means includes a tail switch that is configured to send a signal to the circuit board when the tail is pulled.

13. The electronic figurine of claim 9 further comprising:

a second means for activating the circuit board to generate a pre-programmed response when a user interacts with an orientation of the physical figurine, wherein a user interacting with said orientation interacts with the virtual figurine by generating pre-programmed response.

14. The electronic figurine of claim 9 further comprising:

a gravity switch for activating the circuit board to generate a pre-programmed response when a user turns the physical figurine upside down.

15. The electronic figurine of claim 9 wherein a pre-programmed response includes the ability to change the color of the hair, wherein the ability to change the color of the hair includes light pipes attached to a multi-color LED source, wherein the circuit board is programmed to change the color emitting from the light pipes in response to the user interacting with the appendages.

16. An electronic figurine comprising:

a means for displaying electronic images;

a plurality of appendages extending from the displaying means, wherein the displaying means and the plurality of appendages are arrange to define a physical figurine;

a circuit board programmed to generate images on the image displaying means, wherein the images include facial expressions, virtual activities, games or animated sequences that define a virtual character associated with the physical figurine; and a means for activating the circuit board to display pre-programmed responses that include facial expressions, virtual activates, games or animated sequences, when a user interacts with the appendages of the physical figurine.

17. The electronic figurine of claim 16 further comprising a speaker in communication with the circuit board, and the circuit board is further programmed to emit pre-programmed sounds through the speaker and wherein the pre-programmed responses include sounds such that when a user interacts with the appendages of the physical figurine the circuit board emits various pre-programmed sounds.

18. The electronic figurine of claim 17 wherein at least one appendage includes feet and the activating means includes a foot switch in communication with the circuit board to activate a pre-programmed response when the foot switch is pushed or rubbed.

19. The electronic figurine of claim 18 wherein at least one appendage further includes a tail and the activating means includes a tail switch in communication with the circuit board to activate a pre-programmed response when the tail is pulled.

20. The electronic figurine of claim 19 further comprising:

a means for interconnecting and communicating information between at least two electronic figurines similarly configured.

* * * * *